United States Patent [19]

Simons

[11] Patent Number: 4,991,381

[45] Date of Patent: Feb. 12, 1991

[54] STRETCH WRAPPED BRAKING APPARATUS

[75] Inventor: Robert B. Simons, Newton Falls, Ohio

[73] Assignee: Liberty Industries, Girard, Ohio

[21] Appl. No.: 362,849

[22] Filed: Jun. 7, 1989

[51] Int. Cl.[5] ..... B65B 11/04

[52] U.S. Cl. ..... 53/556; 53/587

[58] Field of Search ..... 53/556, 587, 588, 411; 242/75.2

[56] References Cited

U.S. PATENT DOCUMENTS

| | | | |
|---|---|---|---|
| 967,237 | 8/1910 | Rausch . | |
| 2,433,014 | 12/1947 | Rendel | 242/75.2 |
| 2,485,757 | 10/1949 | Michel | 242/75.2 |
| 2,564,274 | 8/1951 | Pratt | 242/75.2 |
| 2,668,019 | 2/1954 | Holt | 242/75.2 |
| 3,603,857 | 9/1971 | Crane . | |
| 3,867,806 | 2/1975 | Lancaster, III et al. . | |
| 3,919,611 | 11/1975 | Takahashi et al. . | |
| 4,204,377 | 5/1980 | Lancaster et al. . | |
| 4,232,501 | 11/1980 | Stackhouse . | |
| 4,418,510 | 12/1983 | Lancaster | 53/441 X |
| 4,502,264 | 3/1985 | Flaherty | 53/441 X |
| 4,590,746 | 5/1986 | Humphrey | 53/556 |

*Primary Examiner*—John Sipos

*Attorney, Agent, or Firm*—Harpman & Harpman

[57] ABSTRACT

An improvement in a stretch wrapped braking apparatus used to restrict a roll of stretch material on a single roller stretch wrapping apparatus. The improved brake uses a modified controlled magnetic motor to impart braking effect indirectly to the roll of stretch material as it is pulled therefrom by a rotating load to be wrapped.

3 Claims, 2 Drawing Sheets

STRETCH WRAPPED BRAKING APPARATUS

BACKGROUND OF THE INVENTION

1. Technical Field:

This device relates to stretch wrapping machines that make a unitized package by encompassing a multiple part load by a plurality of usually spiral wraps of stretched film material utilizing the rotation of the load to elongate the film from a restrictive supply source.

2. Description of Prior Art:

Prior Art devices of this type have relied on a variety of different film supply brakes to effectively restrict the film as it is pulled from its supply roll and motor brakes to slow an electric magnetic motor, see for example U.S. Pat. Nos. 4,204,377, Pat. 3,867,806, Pat. 4,232,501 Pat. 3,919,611, Pat. 3,603,875 and U.S. Pat. No. 967,237.

In U.S. Pat. Nos. 4,204,377, 3,867,806, and 4,232,501, stretch wrapped process and devices are disclosed that use a magnetic particle brake; in patent ending in 377, a restrictive means characterized by a brake shoe, brake drum and actuation brake lever as illustrated in patent ending in 806. A particle brake is also used in patent ending in 501.

All of the above aforesaid patents rely on common, well known and commercial heat generating braking apparatus.

In U.S. Pat. No. 3,919,611 a braking device for small motors is disclosed that uses a counter electro-magnetic force generated by the motor.

U.S. Pat. No. 3,603,857 discloses a speed control mechanism for controlling a motor to prevent same from exceeding a predetermined maximum speed of rotation of a revolving door.

In U.S. Pat. No. 967,237 a electric hoist is disclosed that uses a braking effect imparted to the hoist motor by driving same backwards with the armature circuit of the motor being closed upon itself.

SUMMARY OF THE INVENTION

An improvement in a stretch wrapped braking device used to restrict the effective rotation of a supply roll of stretch film material as it is being drawn across a load being wrapped. The motor brake of the invention utilizes a motor to generate direct current. Control of the generated current via an electronic circuit with variable control inputs causes a braking motion of the motor and interconnected supply roll of stretch film material thus elongating same as it is drawn across the load to be unitized.

DESCRIPTION OF THE PREFERRED EMBODIMENT

Figure 1:
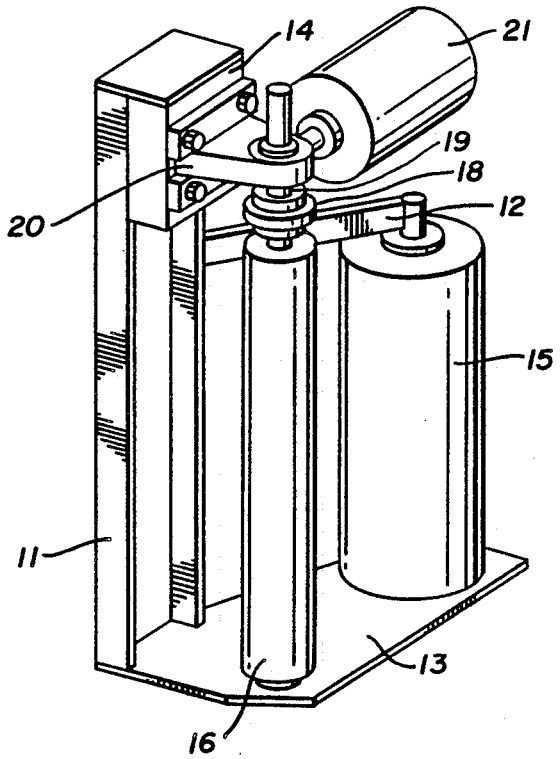
FIG. 1 is a perspective view of a stretch wrapped film dispensing apparatus.
Figure 2:
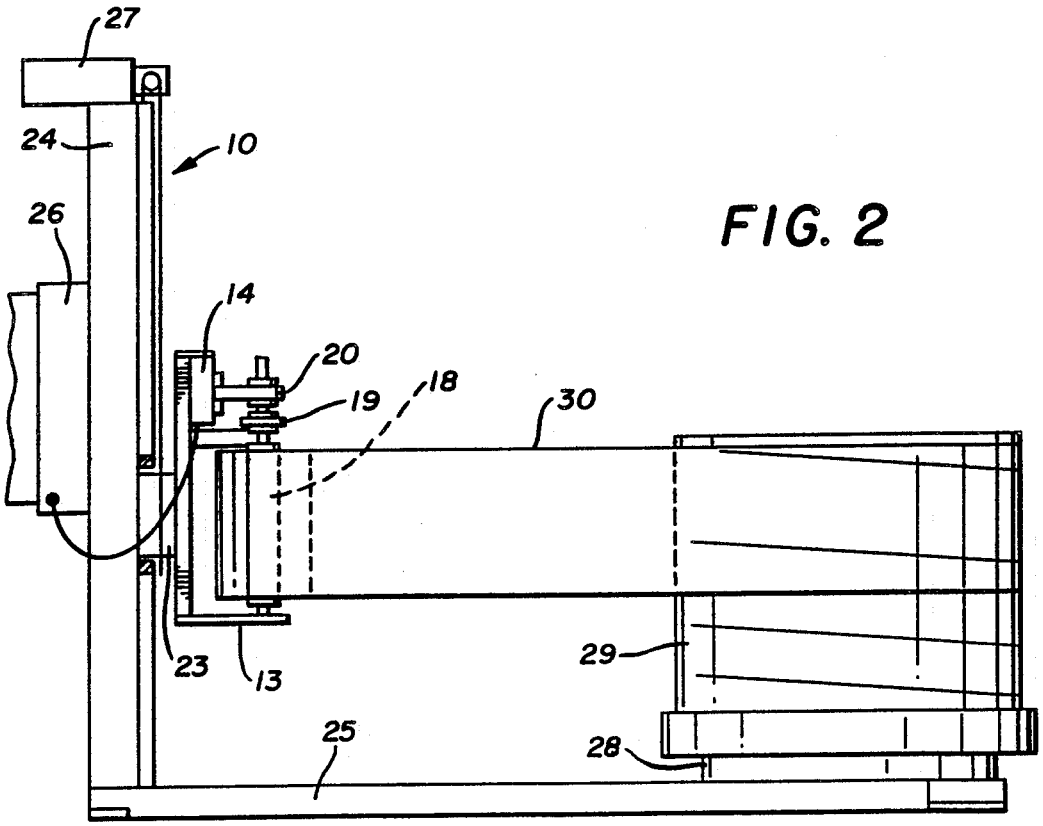
FIG. 2 is a side elevational view of the stretch wrapped film apparatus with its associated load positioned on a turntable in operation.

An improvement in a stretch wrapped braking apparatus for use on a stretch wrapped machine 10, best seen in FIGS. 1 and 2 of the drawings. The stretch wrapped machine 10 has a roll and motor support frame 11 including an upper and lower support bracket 12 and 13 and a motor and coupling support structure 14. A film supply roll 15 is rotatably positioned vertically between said support brackets 12 and 13 in horizontal spaced relation to a braking roller 16 rotatably mounted vertically on said lower support bracket 13 by a bearing 17. The braking roller 16's free end is secured by a coupling 18 to the output shaft 19 of a gear reduction unit 20 of the single worm reduction gear type.

A DC permanent magnet motor 21 is driven by the gear reduction unit 20 and is interconnected to a control circuit 22 see in FIG. 3 of the drawings which will be described in greater detail hereinafter.

Referring to FIG. 2 of the drawings, the roller and motor support frame 11 is secured to a movable carriage 23 within a support and drive stand 24 on a base 25. The support and drive stand 24 has a power source (not shown) and a control enclosure 26 positioned opposite said roller and motor support frame 11. A carriage motor drive assembly 27 is positioned atop the stand 24 and with interconnection means provides sequential vertical movement of the carriage 23 and associated roller and motor support frame 11 in a predetermined, preprogramed manner. A turntable assembly 28 is positioned on said base 25 in spaced relation to said stand 24. A load 29 to be unitized is removably positioned on said turntable and is engaged by a film band 30 extending from the supply roll 15 and over the brake roller 16. It will be evident to those skilled in the art that as the load on the turntable assembly 28 is rotated with the end of the film band 30 attached to the load 29, the movable carriage 23 will begin its predetermined vertical movement to position the film band 30 in an encompassing overlapping relationship on the load 29 characterized by stretch wrapping apparatus in a spiral fashion. Such further explanation of the wrapping sequence is deemed unnecessary since it is well understood and well documented within the art.

Figure 3:
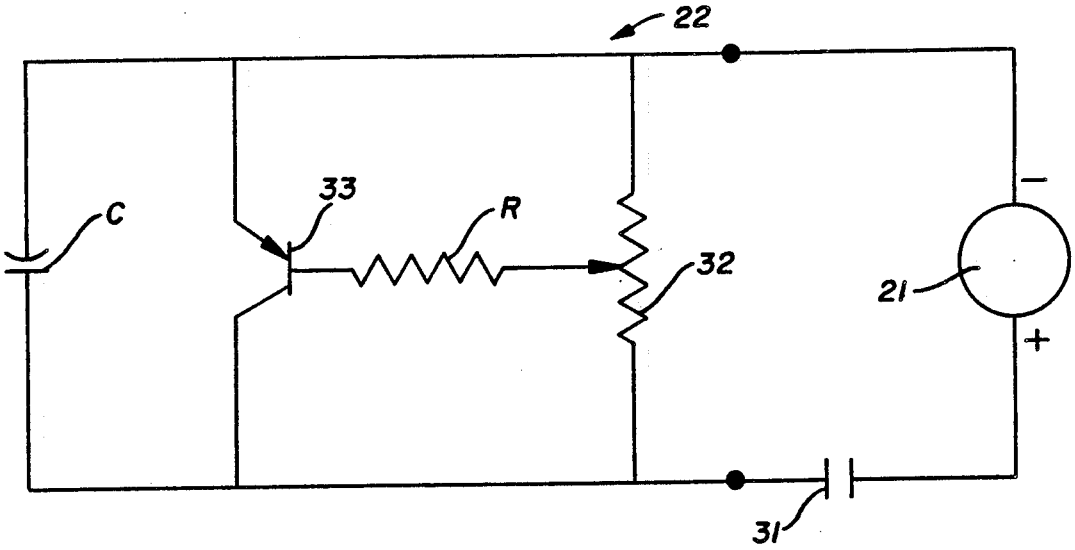
FIG. 3 is an electrical circuit diagram of a motor control circuit.
Figure 4:
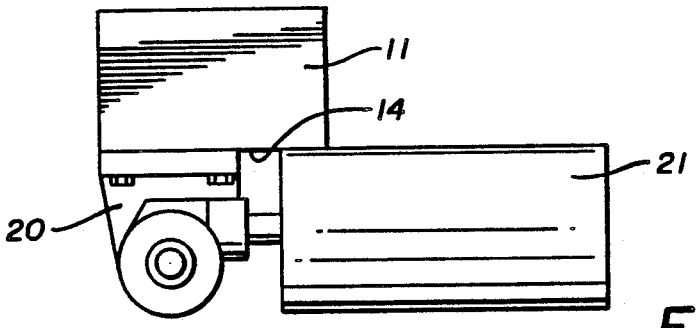
FIG. 4 is an enlarged top plan view on lines 4—4 of FIG. 1.
Figure 5:
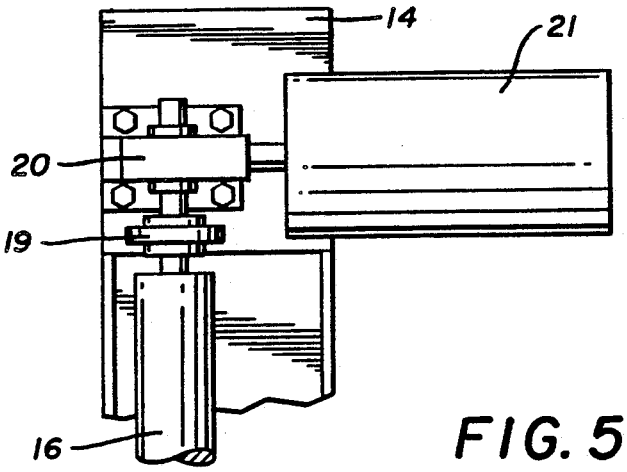
FIG. 5 is a partial side view of a portion of the stretch wrapped film dispensing apparatus.

Referring now to FIg. 3 of the drawings, the control circuit 22 can be seen that effects the braking action imparted to the motor 21 to induce drag to the film band 30 via the braking roller 16 interconnected to same. Once the circuit 22 is activated by the cylce switch at 31 the motor 21 being driven by the brake roller 16 will generate approximately 120 VDC at 1750 R.P.M. As a 100 K potentiometer 32 is engaged it will change the bias on a transistor 33 that will then begin conducting through its emitter and collector imparting a load to be placed on the motor 21. The resistance i.e. load on the motor 21 and interconnected brake roller 16 is variable by the relative adjustment of the potentiometer 32. A capacitor C and resistor R are utilized within the circuit 22 as will be understood by those skilled in the art to make it operable in the preferred form of the embodiment.

It will be apparent that as the braking roller 16 slows down relative the film band 30 speed as it is pulled by the rotation of the load 29 on the turntable assembly 28 that the tension on the film band 30 will cause the same to elongate i.e. stretch to a controlled selected amount by regulation of the potentiometer 32 as hereinbefore described.

By use of the DC permanent magnet motor 21 and the control circuit 22 only limited heat build up is generated which can be easily dissipated by use of a heat sink (not shown). Flaws within the film band material 30 are compensated for automatically due to the relative slow speed in which the motor 21 operates.

It will thus be seen that a new and useful improvement in a braking apparatus for a stretch wrapped machine has been illustrated and described and that various changes and modifications may be made therein without departing from the spirit of the invention.

Therefore I claim:

1. An improvement in a stretch wrap braking apparatus comprising in combination a film supply roll and a braking roller, means for mounting same in spaced relation to one another, a turntable assembly and drive means on which said load is positioned, a stretchable film band from said supply roll connecting said load to said film roll and being moved by the driving means rotating said turntable assembly, a non-powdered DC permanent magnet motor in communication with said braking roller and driven by the movement of the film over the braking roller, a gear transfer means engaging said DC motor and said braking roller, an electronic control circuit means powered by said motor for controlling the speed of said motor and braking roller to stretch said film between said braking roller and the load.

2. The improvement in a stretch wrapped braking apparatus of claim 1 wherein said means for mounting said film supply roll and braking roller comprises a roller and motor support frame, said frame removably positioned on a support and drive stand, means for moving said roller and motor support frame on said stand in sequential controlled relation to said load on said turntable assembly.

3. The improvement in a stretch wrapped braking apparatus of claim 1 wherein said electronic control circuit means comprises a transistor having an emitter, a collector and a base, said emitter being connected to one terminal of said DC motor, said collector connected to the other terminal of said DC motor, a potentiometer connected to the terminals of said DC motors and to the base of said transistor, so that said transistor is reversed biased variably as said potentiometer is regulated manually thereby braking said DC motor when said circuit is activated by a switching means within said circuit.

* * * * *